US005163889A

United States Patent [19]

Kaaua

[11] Patent Number: 5,163,889

[45] Date of Patent: Nov. 17, 1992

[54] COMPACT, PORTABLE FOOT/HAND HOLD DEVICE USED TO PERFORM SIT-UP, LEG-RAISE AND OTHER TYPE EXERCISES

[76] Inventor: Jack L. Kaaua, 540 S. Forest St., 8-203, Denver, Colo. 80222

[21] Appl. No.: 537,262

[22] Filed: Jun. 13, 1990

[51] Int. Cl.[5] ..... A63B 26/00

[52] U.S. Cl. ..... 482/140; 482/904; 482/145

[58] Field of Search ..... 272/900, 112, 125, 145; 182/196, 100; 220/8

[56] References Cited

U.S. PATENT DOCUMENTS

| | | | |
|---|---|---|---|
| D. 226,407 | 2/1973 | Domon | D87/1 R |
| 4,116,434 | 9/1978 | Bernstein . | |
| 4,121,825 | 10/1978 | Hult . | |
| 4,477,073 | 10/1984 | Kock | 272/900 |
| 4,629,179 | 12/1986 | Bizilis . | |
| 4,705,270 | 11/1987 | Melton . | |

FOREIGN PATENT DOCUMENTS

| | | | |
|---|---|---|---|
| 538316 | 6/1922 | France | 272/125 |
| 2544617 | 10/1984 | France | 272/900 |

*Primary Examiner*—Richard J. Apley
*Assistant Examiner*—J. Donnelly

[57] ABSTRACT

A compact, portable foot/hand hold device used to perform sit-up, leg-raise and other type exercises with the help of any ordinary, interior, walk-through door. The device has two modes: "assembled" and "stored/-travel". In the "assembled" mode the device provides a secure, comfortable foot and hand hold for the user while performing several type exercises. Constructed of three simple parts; an anchor, a connecting line and a foot/hand bar, the device assemblies in seconds. It is secured to the door by the anchor. For sit-up type exercises the user places his feet behind the foot/hand bar, one on each side of the connecting line, so that the bar is resting snugly but comfortably in the hollows above the insteps of the feet. His feet are necessarily positioned such that the heels are resting on the floor and the balls of his feet are pressed firmly against the vertical plane of the door. For leg-raise type exercises, the user holds the foot/hand bar in both hands while lying on his back with his arms fully extended above his head. In the preferred embodiment of the device, the connecting line is originally and permanently adjusted to fit the user's own foot (size) while wearing athletic shoes. In the "stored/travel" mode the device is completely compact and totally portable, the purpose being a minimum of space and weight.

18 Claims, 3 Drawing Sheets

COMPACT, PORTABLE FOOT/HAND HOLD DEVICE USED TO PERFORM SIT-UP, LEG-RAISE AND OTHER TYPE EXERCISES

BACKGROUND OF THE INVENTION

It is well established that sit-ups and leg-raises types of exercises are some of the most advantageous calisthenics for the abdominal, waist, lower back and leg muscles which a person can incorporate a personal fitness regimen. When these are done on a regular basis they prove to be extremely beneficial.

This invention was conceived out of a need for a device that could be used to assist in the performance of certain physical exercises in a hotel room, office, shop, etc. and that would be completely compact and totally portable; and made of a durable material that would not "trigger" airport security machines, nor present a "questionable" object on airport x-ray screens. Because this inventor travels extensively in his present work and maintains a very irregular schedule, as do many, there is additional need for a device which can be used anywhere there is an ordinary, interior door; and at any time he so desires (not being held to the confines and time tables of a gym or athletic club.) There was further need to develop a device that is completely compact and totally portable which can fit easily into a briefcase, ladie's purse, flightbag, school pack, or even a pocket; the idea being a minimum of space and weight—most similar apparatuses being relatively heavy, bulky metal and of irregular configurations.

Additionally there is need for a device which is easy to use, comfortable, effective, safe, convienant, flexible in use, durable, simple in form and economical. Whereas some of the prior art individually may have some of the features of the present invention, none of them has the collective attributes of the present invention nor a substantial portion thereof. The specifics of these attributes shall become apparent presently.

THE PRESENT INVENTION

The specific objective of the present invention is to provide a completely compact, totally portable foot/-hand hold device designed to assist the user in several certain exercises which can be performed anywhere there is an ordinary, interior, walk-through door. It is basically intended for the active person, or one who travels extensively, hence is designed to easily fit into a briefcase, ladie's purse, flightbag, school pack, or even a pocket.

The present invention consists of two modes: "assembled" and "stored/travel". It consists of an anchor made of durable, lightweight, rigid plastic; tubular in form with a narrow slot running longitudinally from one open end to its centerpoint. Its other end is sealed. The anchor is designed to anchor the entire device (when assembled) to the backside of any ordinary, interior door. The second part is a short connecting line made of ordinary rope and knotted at both ends. It is designed to connect the first and third parts to each other; and to provide tension when in use. The third part is a foot/hand bar, similar to the first part (anchor); except proportionally longer and smaller in diameter. It is designed for two purposes: 1) to secure the feet or hands respectively while the user performs various exercises, and 2) to contain the connecting line and friction fit into the first part (anchor) when in the "stored/travel" mode; rendering the entire device a short wand-like (or stick) configuration.

There are several advantages of the present invention over similar apparatuses. Because of the great number and extensive variations of other such apparatuses, it will be most clear to list the advantages of the present invention in a comparative format. This is to say that no prior art combines all these attributes to produce a similar device. The advantanges of the present invention are as follows. It has fewer parts; only three. It is totally portable; compacts to ten inches and weighs six ounces. It has flexibility of use; several types of exercises which include, but are not limited to: sit-ups, leg-raises, stretches and isometrics and isotonics (for the more advanced users). It will not "trigger" airport security machines or present a "questionable" object on airport x-ray screens; being constructed of plastic and rope. It is easier to use; can be assembled, set up and broken down in seconds. It is more convienant; can be "stored" (hung) over a door knob. It is safer; will not protrude from the door causing a foot traffic hazard nor will it cause injury if dropped on someone. It is projected to be significantly lower in cost; having only three simple parts. It is comfortable; holds the users feet at the most desirable acute angle to the floor during sit-up exercises, and keeps them secure and immobile. It is durable; none of its parts are prone to wear. It will not mar or damage the door; again, because of its materials. It has a personalized fit; is adjusted to the users own foot (size) permanently. The preferred embodiment of the present invention combines these advantages to provide a unique exercises device with optimum attributes.

BRIEF DESCRIPTION OF THE DRAWINGS

The accompanying drawings illustrate the preferred embodiment of the invention in which.

DESCRIPTION OF THE PRIOR ART

Figure 1:
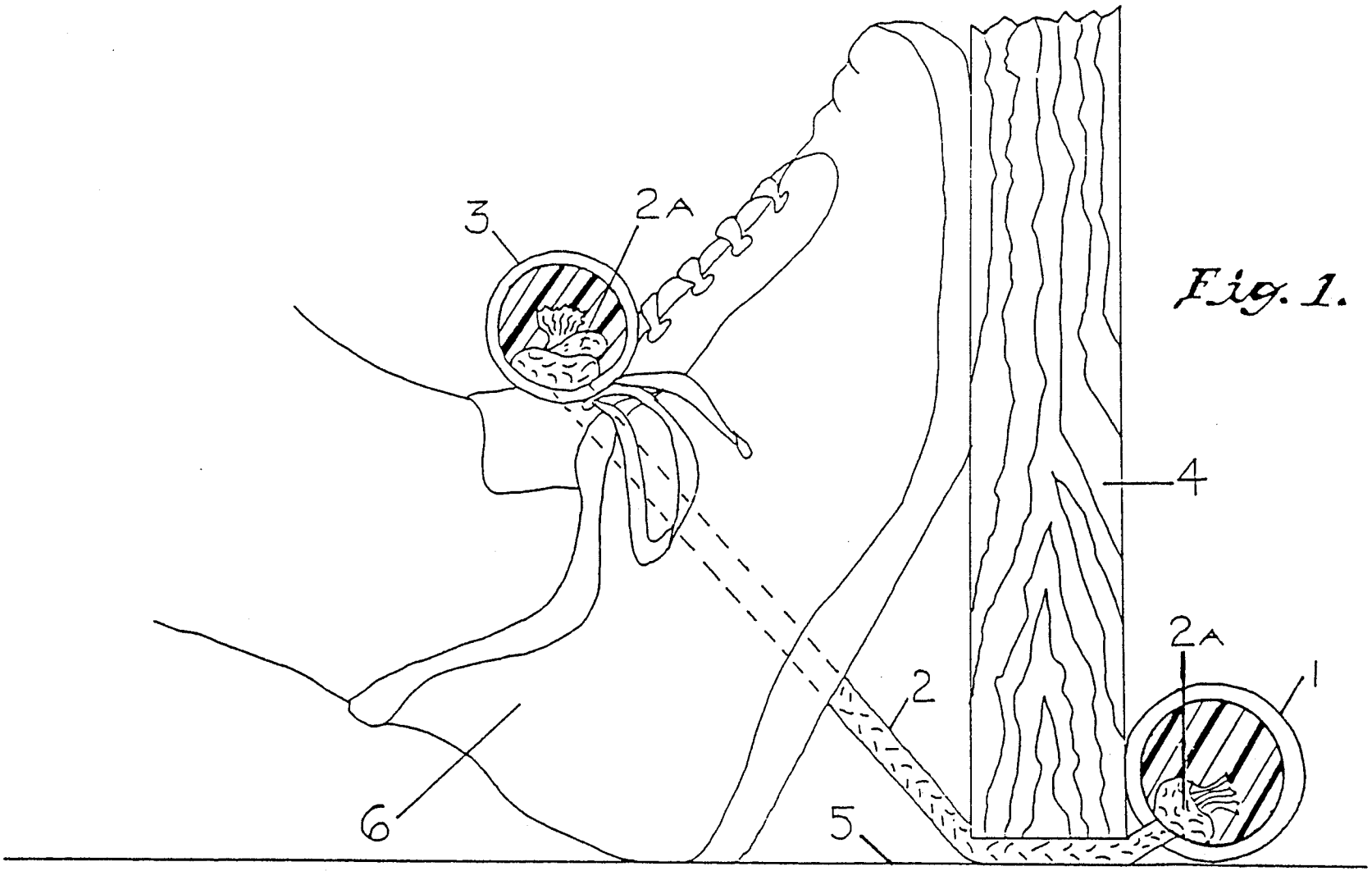
FIG. 1 is a side view of the device anchored to a door and engaging the user's foot with the foot/hand bar demonstrating the desired acute angle of the foot to the floor.

U.S. Pat. No. 4,116,434
U.S. Pat. No. 4,121,825
U.S. Pat. No. 4,468,022
U.S. Pat. No. 4,629,179
U.S. Pat. No. 4,705,270
U.S. Pat. No. 4,752,067
U.S. Pat. No. 4,809,971

Whereas some of the prior art may have some of the features or attributes of the present invention collectively, none of them has all of these advantages, nor a significant portion thereof.

For instance, in U.S. Pat. No. 4,116,434 the apparatus is extremely complex in construction with many parts. In addition, it is made of heavy metal and relatively bulky. It provides less comfort than the present invention because the user must flex his instep against the bar while exercising; possibly causing foot cramping. One embodiment can also cause a foot traffic hazard while attached to the door by protruding out from the door. And its relative cost is high.

In U.S. Pat. No. 4,121,825 a set (two) of devices must be used which once again, are complex in construction with many parts. Here too, the feet are held stationary but not immobile. And the feet must be individually adjusted to each device with each use. The devices (together) are much bulkier than the present invention and made of "detectable" metal. Only one exercise can be performed with these apparatuses.

With U.S. Pat. No. 4,468,022 there is once again the disadvantage of complex construction with many parts and a higher cost. It also presents a safety hazard to foot traffic when attached to the door. And it is relatively heavy, bulky and constructed of metal; not being truly compact or portable as the present invention. Further there is the same drawback as mentioned in U.S. Pat. No. 4,116,434 with respect to the user's foot possition relative to the bar.

U.S. Pat. No. 4,629,179 necessitates two devices, both of which are complex in construction with many parts. These present a very bulky item not suitable for convenient transport (travel). Additionally only sit-ups can be performed and these must be done barefooted. The set up and break down time for both devices is also substantially longer than the present invention. And this device, too, can present a foot traffic hazard when attached to the door. Their cost is seen as substantially higher also.

U.S. Pat. No. 4,705,270 has a complex construction with many parts. Some of these parts are prone to wear out. It is also less convienant to use as both feet must be individually adjusted to the apparatus each time it is used. Additionally, while the feet are held securely; they are not immobile. It too is relatively bulky. Only one or two exercises can be performed with this device.

U.S. Pat. No. 4,752,067 is mentioned only because it is designed to perform the same abdominal type exercises as the primary function of the present invention. It is extremely bulky and hence not conveniently transported in hand luggage. Its cost is relatively higher than the present invention.

And U.S. Pat. No. 4,809,971 is included here primarily to illustrate the less desirable possition of the feet; i.e., flat on the floor, when in use. Here, also, there are two apparatuses needed; each of complex construction and many parts. These devices are relatively bulky, and again, only one exercise can be performed with them.

Of all the similar prior art thus far patented, this inventor can only find one basic type that is currently being marketed on a retail level. This leads him to believe that the others do not function properly, are not pratical or have been refused for manufacture and marketing because of some serious defect. It further illustrates the need for a product that is truly effective, compact and portable, durable, safe and affordable as is the present invention.

THE PREFERRED EMBODIMENT OF THE INVENTION

In the preferred embodiment of the invention, there are three simple parts; an anchor 1, a connecting line 2 and a foot/hand bar 3.

In FIG. 1 the anchor 1 is shown from an end view containing the connecting line's 2 knott 2A which is held in place by a narrow slot cut longitudinally in the anchor 1 from one open end to its centerpoint; the knott 2A having sufficient bulk so that it cannot pass through the slot. The anchor 1 is held in place by tension on the connecting line 2. The anchor 1 is constructed of lightweight, rigid, durable plastic and is tubular in form with one end sealed; and serves to anchor the entire device to any ordinary, interior, walk-through door 4. The connecting line 2 made of ordinary rope, is knotted 2A at both ends and serves to connect the anchor 1 to the foot/hand bar 3 as well as create tension to support the feet 6 (or hands) when a user engages the device with the door 4. The tention is achieved by the respective knotts 2A being secured in the respective slots, and the feet 6 being positioned between the foot/hand bar 3 and the door 4. The foot/hand bar 3 is similar to the anchor 1 except proportionately longer and narrower in diameter, and serves to secure the feet 6 by resting in the hollows above the insteps of the feet 6 snugly but comfortably while the heels rest on the floor 5 and the balls of the feet 6 are pressed firmly against the vertical plane of the door 4; thus creating a most desirable acute angle of the feet 6 to the floor 5.

Figure 2:
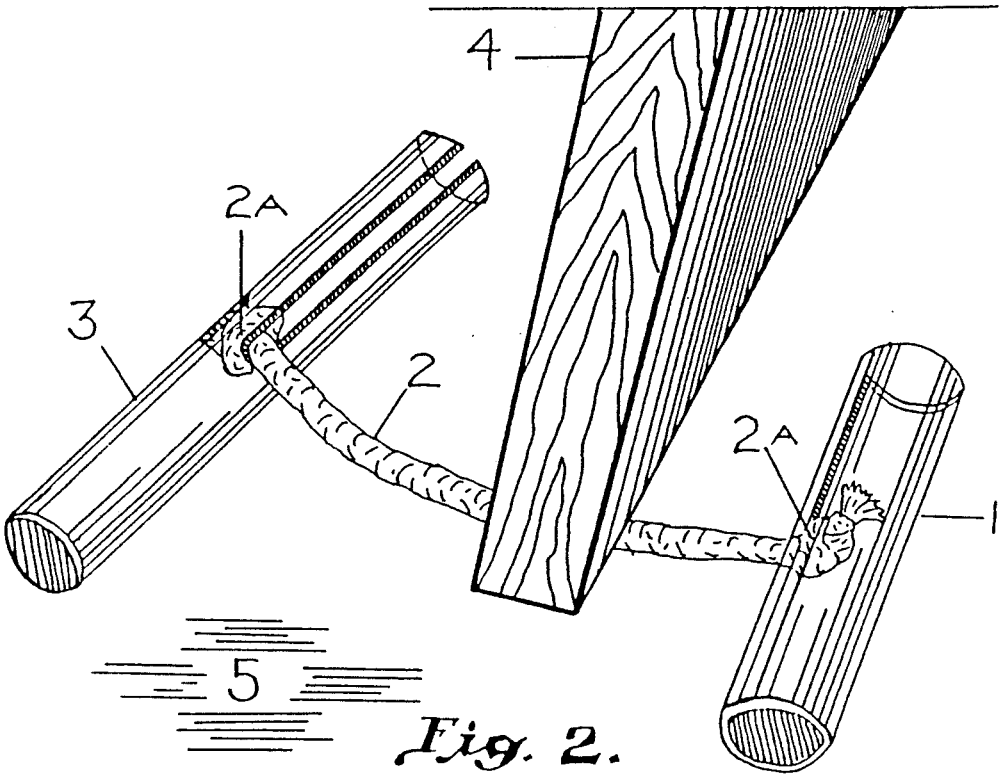
FIG. 2 is a perspective top view of the device in the "assembled" mode, on the floor relative to the door to be used, the door not yet in the closed and latched possition.

In FIG. 2 the device in the "assembled" mode is shown on the floor 5 relative to the door 4. The anchor 1 is shown on the backside of the door 4, connected by the connecting line 2; running under the door 4, to the foot/hand bar 3 on the front (exercise area) side of the door 4. The door 4 has not yet been closed and latched for use during exercising. The connecting line's 2 knotts 2A are shown secured in their respective slots in the anchor 1 and the foot/hand bar 3.

Figure 3:
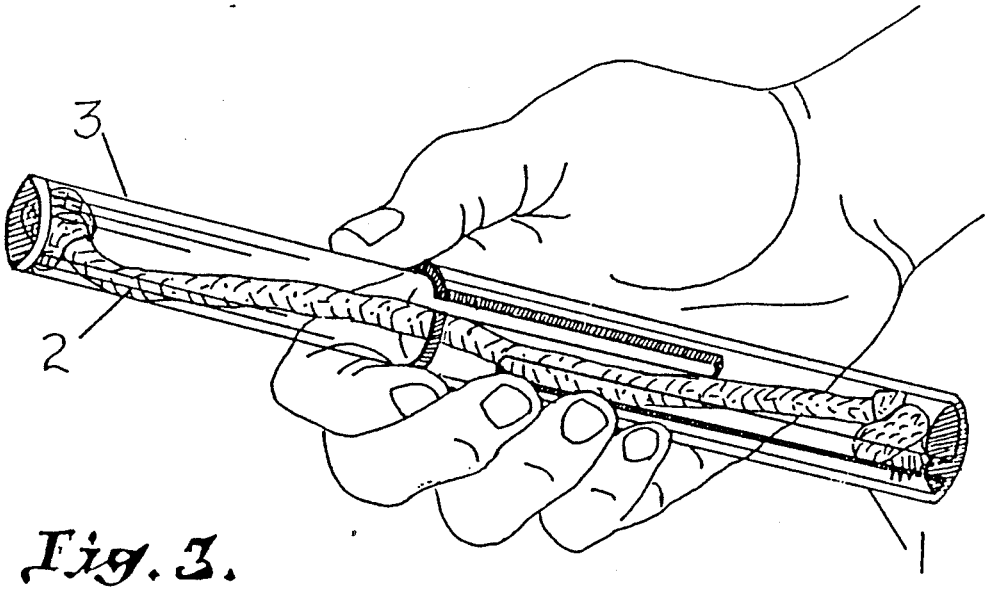
FIG. 3 is a perspective view of the device in the compact "stored/travel" mode being held in the hand.

In FIG. 3 the device in the "stored/travel" mode is shown held in the hand. In this mode the connecting line 2 is full inserted into the one open end of the foot/-hand bar 3, which is then subsequently fully inserted into the anchor 1, and held fast by friction fit; creating a wand-like (or stick) configuration for easy storage and/or travel. This embodiment, as the previous ones, is here demonstrated in transparent plastic.

Figure 4:
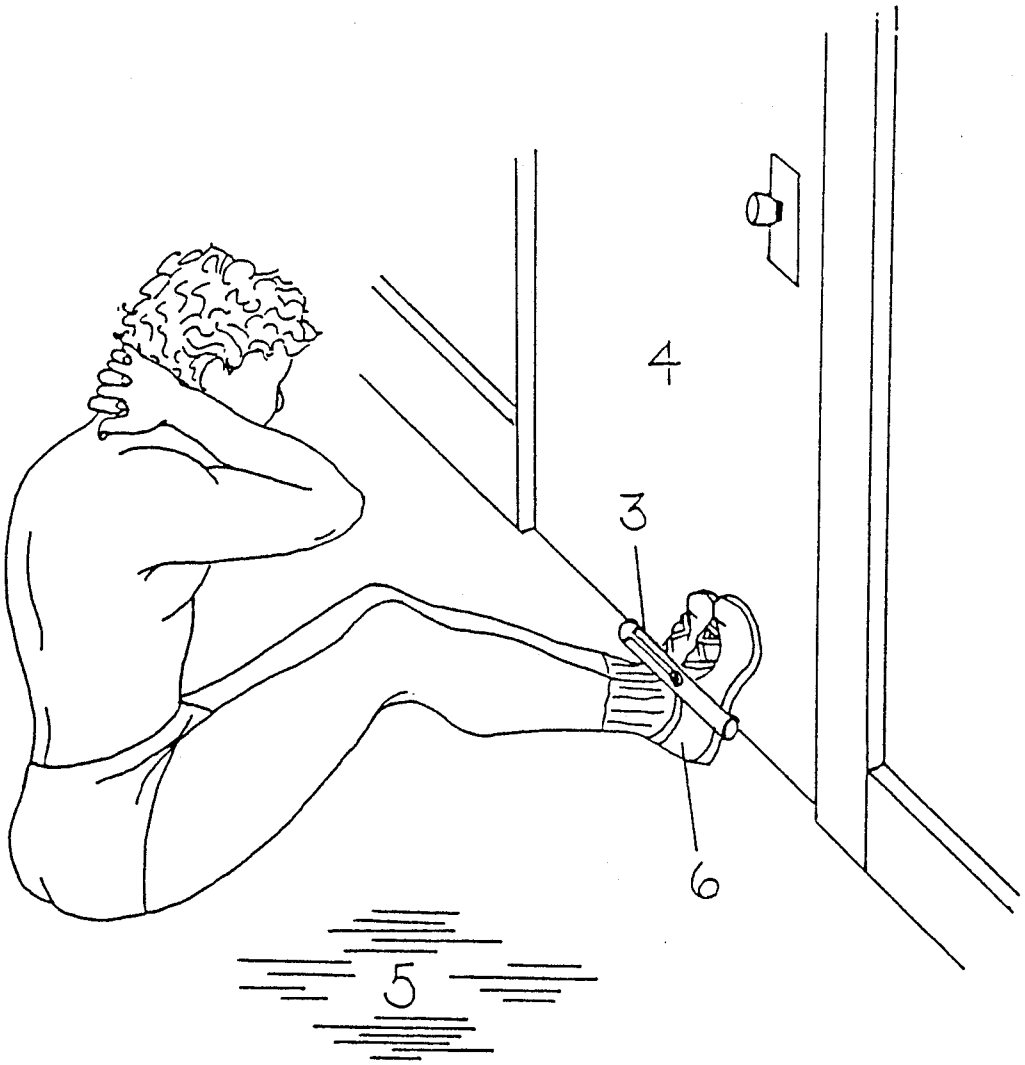
FIG. 4 is a perspective view of the device being used to do sit-ups, engaging the user's feet and anchored to a door.

FIG. 4 is a perspective view of the device being used to do sit-up exercises with the foot/hand bar 3 engaging the user's feet 6 while anchored to a door 4. It is herein demonstrated how the feet are held securely by the foot/hand bar 3 resting in the hollows above the insteps of the feet 6 so that the heels of the feet 6 are resting on the floor 5 and the balls of the feet 6 are pressed firmly against the vertical plane of the door 4; thus creating a most desirable acute angle of the feet 6 to the floor 5 and necessarily causing the knees to be bent so that the abdominal and waist muscles are exercised while reducing the strain on the underlegs and lower back areas.

It is thus demonstrated from the preceeding descriptions and the drawings herein that the preferred embodiment of the present invention provides a completely compact, totally portable foot/hand hold device for performing sit-up, leg-raise and other exercises with the assistance of any ordinary, interior, walk-through door; and that said invention is preferrable and superior to other similar apparatuses because of its simplicity of construction, flexability and comfort of use, low cost, compactness, portability, ease of operation (assembly and set up), durability, personalized fit, effectiveness and safety features.

The disclosure of the present invention described herein above represents the preferred embodiment of the invention; however, variations thereof, in form, construction, materials and arrangement, and the modification of use of the invention are possible without departing from the spirit, purpose and scope of the appended claims.

I claim:

1. A device for performing various exercises in association with an ordinary interior walk through door, comprising:

a first substantially tubular member dimensioned to not pass beneath a door;

a second substantially tubular member dimensioned for abutment with a user's feet and for grasping by a user's hands;

said first member being elongated, substantially tubular and having one open end and one closed end;

a first slot extending substantially longitudinally from said open end of said first member along a sidewall of said first member;

said second member being elongated, substantially tubular and having one open end and one closed end;

a second slot extending substantially longitudinally from said open end of said second member along a sidewall of said second member;

a flexible connecting member having an enlarged portion formed at each of two opposite ends; and said connecting member dimensioned to pass through said slots in said first and second members and said enlarged portions dimensioned to be received in said first and second members and not pass through said slots for selectively connecting said first and second members together; and one of said first and second members dimensioned to be at least partially telescopically received and frictionally retained within the other of said first and second members for forming a substantially enclosed interior portion dimensioned to receive said connecting member for storage and transportation.

2. The device of claim 1, wherein said first slot extending along said first member extends along about half the length of said first member and said second slot extending along said second member extends along about half the length of said second member.

3. The device of claim 1, wherein said first and second members are formed from a rigid material.

4. The device of claim 1, wherein an inner one of said at least partially telescopically received first and second members is substantially longer than an outer one of said at least partially telescopically received first and second members.

5. A device for use in performing various types of exercises in association with an ordinary interior walk-through door, comprising:

a first substantially tubular member having one open end and an opposite closed end, said first member dimensioned to not pass beneath a door;

a second substantially tubular member having one open end and an opposite closed end, said second member dimensioned for abutment with a user's feet and for grasping by a user's hands;

a flexible connecting member removably connectable between said first and second members, said flexible connecting member dimensioned to pass beneath a door;

one of said first and second members dimensioned to be at least partially telescopically received within the other of said first and second members for forming a substantially enclosed interior portion dimensioned to receive said flexible connecting member for storage and transportation; and said first and second members dimensioned so as to be frictionally retained in telescoping relation.

6. The device of claim 5, further comprising means for removably securing said first and second members to opposite ends of said flexible connecting member.

7. The device of claim 6, further comprising a slot in at least one of said first and second members; and an enlarged portion adjacent one end of said flexible connecting member engaged with said slot.

8. The device of claim 7, wherein said enlarged portion comprises a knot in said flexible connecting member.

9. The device of claim 5, wherein said first and second members are substantially cylindrical.

10. The device of claim 5, wherein said first and second members are substantially rigid.

11. The device of claim 5, wherein said connecting member comprises rope.

12. A device for use in performing various types of exercises in association with an ordinary interior walk-through door, comprising:

a first substantially tubular member having one open end and an opposite closed end, said first member dimensioned to not pass beneath a door;

a second substantially tubular member having one open end and an opposite closed end, said second member dimensioned for abutment with a user's feet and for grasping by a user's hands;

a flexible connecting member removably connectable between said first and second members, said flexible connecting member dimensioned to pass beneath a door;

one of said first and second members dimensioned to be at least partially telescopically received within the other of said first and second members for forming a substantially enclosed interior portion dimensioned to receive said flexible connecting member for storage and transportation; and an inner one of said at least partially telescopically received first and second members being substantially longer than an outer one of said at least partially telescopically received first and second members.

13. The device of claim 12, further comprising means for removably securing said first and second members to opposite ends of said flexible connecting member.

14. The device of claim 13, further comprising a slot in at least one of said first and second members; and an enlarged portion adjacent one end of said flexible connecting member engaged with said slot.

15. The device of claim 14, wherein said enlarged portion comprises a knot in said flexible connecting member.

16. The device of claim 12, wherein said first and second members are substantially cylindrical.

17. The device of claim 12, wherein said first and second members are substantially rigid.

18. The device of claim 12, wherein said connecting member comprises rope.

* * * * *